United States Patent [19]

Grosso

[11] 4,380,974

[45] Apr. 26, 1983

[54] FUEL SUPPLY SYSTEM FOR AN INTERNAL COMBUSTION ENGINE

[75] Inventor: Carlo Grosso, Turin, Italy

[73] Assignee: Fiat Auto S.p.A., Turin, Italy

[21] Appl. No.: 247,031

[22] Filed: Mar. 24, 1981

[30] Foreign Application Priority Data

Mar. 24, 1980 [IT] Italy ..... 67447 A/80

[51] Int. Cl.[3] ..... F02N 17/00

[52] U.S. Cl. ..... 123/179 G; 123/576; 123/515

[58] Field of Search ..... 123/576, 180 AC, 515, 123/187.5 R, 179 G, 575.1 A, 577

[56] References Cited

U.S. PATENT DOCUMENTS

| | | | |
|---|---|---|---|
| 1,506,229 | 8/1924 | Ensign | 123/548 |
| 1,829,050 | 10/1931 | McClure | 123/179 G |
| 2,821,183 | 1/1958 | Rossa | 123/187.5 R |
| 2,985,159 | 5/1961 | Moseley | 123/187.5 R |
| 3,620,202 | 11/1971 | Ross | 123/187.5 R |
| 4,031,864 | 6/1977 | Crothers | 123/1 A |
| 4,085,720 | 4/1978 | Etoh | 123/179 G |
| 4,204,489 | 5/1980 | Onishi | 123/179 G |

FOREIGN PATENT DOCUMENTS

| | | | |
|---|---|---|---|
| 2653877 | 7/1977 | Fed. Rep. of Germany | 123/179 G |

*Primary Examiner*—Charles J. Myhre
*Assistant Examiner*—E. Rollins Cross
*Attorney, Agent, or Firm*—Sughrue, Mion, Zinn, Macpeak and Seas

[57] ABSTRACT

A carburetor for an internal combustion engine adapted to use alcohol as fuel is provided with means for adding a predetermined amount of gasoline to the alcohol-containing float chamber of the carburetor during engine starting and warming-up, said means being controlled by the choke valve of the carburetor.

2 Claims, 3 Drawing Figures

FUEL SUPPLY SYSTEM FOR AN INTERNAL COMBUSTION ENGINE

Figure 1:
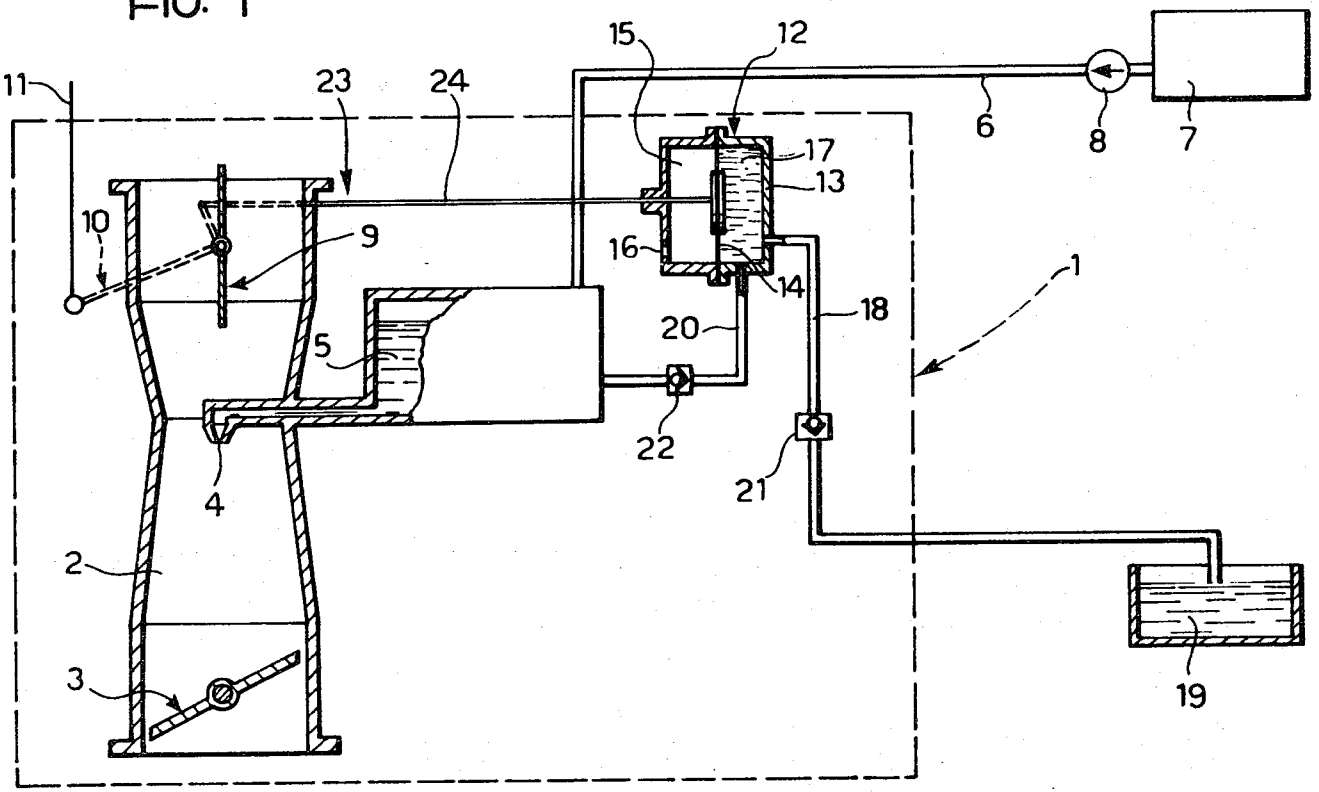

The present invention relates to internal combustion engines which are adapted to use alcohol as fuel during normal operating conditions and a mixture of alcohol and gasoline during starting and warming-up.

The invention relates in particular to a fuel supply system for use in an internal combustion engine of the abovementioned type, said system comprising:

a carburettor, including an air passage, a float chamber and a fuel spray nozzle disposed within said air passage and connected to said float chamber, an alcohol-containing main fuel tank connected to said float chamber, and a gasoline-containing auxiliary fuel tank connected to said carburettor.

A fuel supply system having the abovementioned features is disclosed in U.S. Pat. No. 1,506,229. In this known system, the gasoline-containing auxiliary fuel tank is disposed at a level higher than the carburettor and is connected to the latter by means of a conduit in which a needle valve is interposed. In order to start the engine, the attendant must operate the needle valve, causing opening of the same, so that a charge of gasoline flows by gravity from the auxiliary fuel tank to the carburettor and is mixed to the alcohol fed to the engine.

The main drawback of this known system is that it requires the intervention of the operator in order to cause the charge of gasoline to be added to the alcohol fed to the engine during starting and warming-up.

It is also known to provide a fuel supply system of the above described type, in which the gasoline-containing auxiliary fuel tank is connected to the air passage of the carburettor and an auxiliary pump is interposed in such connection. The auxiliary pump must be operated in order to feed gasoline from the auxiliary tank to said air passage during starting and warming-up of the engine. Thus, also this known system requires the intervention of the operator. Moreover, the operator has no control, in this case, of the amount of gasoline which is fed to the engine.

It is the object of the present invention to provide a fuel supply system for an internal combustion engine adapted to use alcohol as fuel, in which a very precise amount of gasoline is automatically added to the fuel fed to the engine during starting and warming-up.

This object is achieved, according to the present invention, by providing a fuel supply system of the above described type, further comprising:

a choke valve within the air passage of the carburettor, upstream of said fuel spray nozzle, a choke valve actuating mechanism, a gasoline supply diaphragm device, including a hollow casing and a diaphragm member within said hollow casing which defines a first chamber vented to the atmosphere, and a second chamber, a first conduit connecting said second chamber to said auxiliary fuel tank, a second conduit connecting said second chamber to said float chamber, a first and a second one-way valves interposed in said first and second conduits respectively, preventing flow of fuel from the second chamber to the auxiliary fuel tank and from the float chamber to the second chamber, a connection mechanism connecting said choke valve actuating mechanism to said diaphragm member of the gasoline supply device; said connection mechanism causing displacement of said diaphragm member towards a position in which said second chamber has a minimum volume, when said choke valve is in its operating position during starting and warming-up of the engine.

In the fuel supply system according to the invention, when the choke valve actuating mechanism is operated for cold starting, the abovementioned connection mechanism causes a displacement of the diaphragm member towards a position in which said second chamber has a minimum volume, whereby a precise amount of gasoline is automatically fed from the second chamber to the alcohol containing float chamber via said second conduit. When the choke valve is returned to its nonoperating position, upon warming-up of the engine, the diaphragm member returns to its normal position, whereby a new amount of gasoline is fed from the auxiliary tank to the second chamber via said first conduit.

Figure 2:
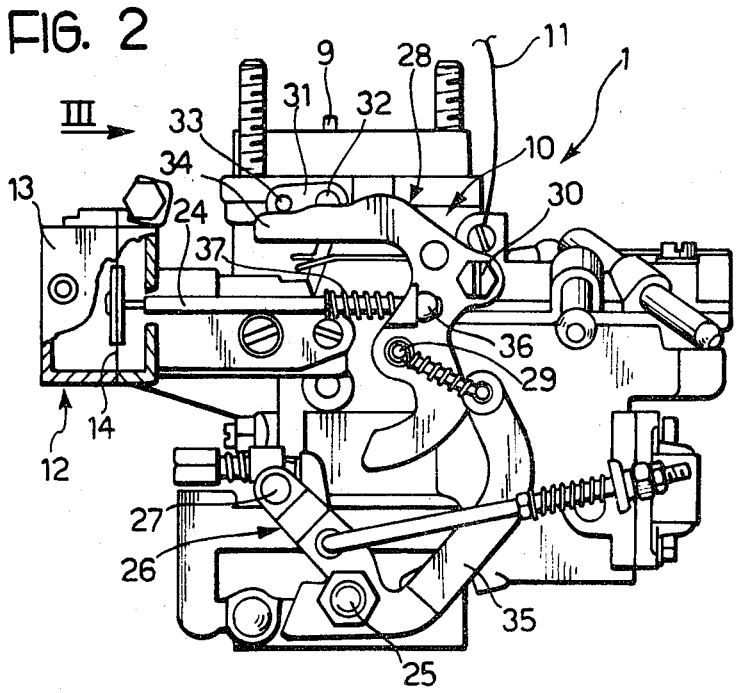
Figure 3:
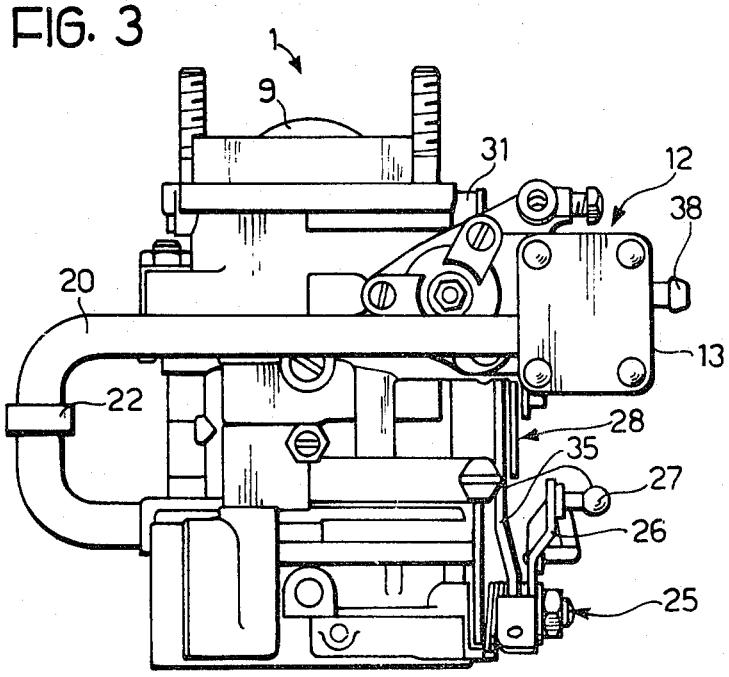

The foregoing and further features and advantages of the present invention will be apparent from the following more particular description, with reference to the accompanying drawings, in which:

FIG. 1 is a schematic view of the system according to the present invention, and FIGS. 2 and 3 are a front and a side view of a carburettor according to the preferred embodiment of the invention.

In the drawings, reference No. 1 indicates a carburettor for use in an internal combustion engine which utilizes alcohol as fuel. The carburettor 1 comprises an air passage 2, a throttle valve 3 disposed within the air passage 2 and a spray nozzle 4 disposed within the air passage 2 upstream of the throttle valve 3. The spray nozzle 4 is connected to a float chamber 5 which is also connected by means of a conduit 6 to a main fuel tank 7, filled with alcohol. A fuel pump 8 is interposed in the conduit 6 to feed alcohol from the main fuel tank 7 to the float chamber 5. The float chamber 5 is provided with a known float mechanism (not shown) to ensure a constant level of fuel inside thereof.

The carburettor 1 further comprises a choke valve 9 disposed in the air passage 2 upstream of the spray nozzle 4. The choke valve 9 is connected to a choke valve actuating mechanism 10, including a cable 11 which can be operated against the bias of spring means (not shown) to cause displacement of the choke valve 9 from the illustrated nonoperating position to a closed operating position.

The carburettor 1 comprises a diaphragm device 12 having a hollow casing 13 and a diaphragm member 14 which is disposed within the hollow casing 13 and defines two chambers inside thereof. A first chamber 15 is vented to the atmosphere through a port 16. A second chamber 17 is connected by a first conduit 18 to an auxiliary fuel tank 19, filled with gasoline, and by a second conduit 20 to the float chamber 5. Two one-way valves 21, 22 are interposed in conduit 18,20 respectively, in order to prevent flow from the float chamber 5 to the second chamber 17 and from the latter to the auxiliary fuel tank 19.

The carburettor 1 further comprises a connection mechanism 23 connecting the choke valve actuating mechanism 10 to the diaphragm member 14. The connection mechanism 23 includes an actuating rod 24 having one end fixed to the diaphragm member 14 and the other end connected to the actuating mechanism 10. The rod 24 is slidably mounted within the hollow casing 13 of the diaphragm device 12.

During normal operation of the engine, alcohol is fed from float chamber 5 to the spray nozzle 4 and is mixed to the air flowing through the air passage 2.

In order to start the engine, especially in winter time, the cable 11 must be operated in order to take the choke valve 9 to its closed operating position. A linkage mechanism connects, in a way known per se, the choke valve 9 to the throttle valve 3 so as to cause the throttle valve 3 to move to a partially open position (the so-called "fast-idle" position) when the choke valve 9 is moved to its operating position. In such a condition, the rod 24 slides rightwards (with reference to FIG. 1) moving the diaphragm member 13 to a position in which the second chamber 17 has the minimum volume. As a result of this, a precise amount (corresponding to the reduction of volume of second chamber 17) of gasoline is fed from the second chamber 17 to the float chamber 5 through the conduit 20 and the valve 22. The gasoline coming from chamber 17 is thereby mixed to the alcohol in the float chamber 5.

Preferably, the charge of gasoline is such that the alcohol-gasoline mixture comprises 95% alcohol and 5% gasoline.

When, upon warming-up of the engine, the choke valve actuating mechanism 10 is disactivated, spring means (not shown) return the choke valve 9 to its non-operating position. Thus, the diaphragm member 25 returns to the position shown in FIG. 1, and a new amount of gasoline is sucked from the auxiliary fuel tank 19 through the conduit 18 and the valve 21.

FIGS. 2,3 show a preferred embodiment of the carburettor 1. In such figures the elements corresponding to those shown in FIG. 1 are indicated by the same reference numerals.

Reference numeral 25 indicates the shaft of throttle valve 3 to which an actuating lever 26 is connected. The lever 26 has one end supporting a spherical element 27 for connection to the usual actuating cable. The choke valve actuating mechanism 10 comprises a lever 28 pivoted to the fixed structure of the carburettor around an axis 29 and provided with a bolt 30 for connection to the actuating cable 11. The actuating mechanism 10 further comprises a lever 41 mounted onto one of the choke valve shaft 32 and carrying a follower element 33 cooperating with an arm 34 of the lever 28. The above-mentioned linkage mechanism connecting the choke valve actuating mechanism 10 to the throttle valve mechanism comprises a lever 35 having its ends cooperating with the lever 28 and the lever 26, respectively.

The particular structure and arrangement of levers 28, 26 and 35 is known per se and does not form part of the present invention.

The actuating rod 24 connected to the diaphragm member 14 has its end opposite to the diaphragm member 14 connected to the lever 28 by means of a spherical joint 36. A spring 37 is interposed between the lever 28 and the rod 24 in order to take up any play which may occur between such elements.

When the cable 11 is actuated, the lever 28 rotates counterclockwise (with reference to FIG. 2) around the axis 29 and rod 24 moves leftwards causing the charge of gasoline to be fed from chamber 17 to the float chamber 5. Lever 35 holds the throttle valve 3 in its "fast-idle" position when the choke valve is in its operating position.

In FIG. 3 reference numeral 38 indicates a pipe for connection of conduit 21 to the second chamber 17 of the diaphragm device 14.

As it would be clearly understood from the foregoing description, the fuel supply system according to the present invention may be of simple and economic construction.

While the invention has been particularly shown and described with reference to a preferred embodiment thereof, it will be understood by those skilled in the art that various changes in form and details may be made therein without departing from the spirit and scope of the invention.

I claim:

1. A fuel supply system for an internal combustion engine comprising:

a carburetor including an air passage, a float chamber, and a fuel spray nozzle disposed within said air passage and connected to said float chamber, an alcohol-containing main fuel tank connected to said float chamber, a fuel pump in the connection of said main fuel tank to said float chamber, and a gasoline-containing auxiliary fuel tank, a choke valve within the air passage of the carburetor, upstream of said fuel spray nozzle, a gasoline supply diaphragm device, including a hollow casing and a diaphragm member within said hollow casing, which defines a first chamber vented to the atmosphere, and a second chamber, a first conduit connecting said second chamber to said auxiliary fuel tank, a second conduit connecting said second chamber to said float chamber, first and second one-way valves interposed in said first and second conduits respectively, preventing flow of fuel from the second chamber to the auxiliary fuel tank and from the float chamber to the second chamber, a choke valve actuating mechanism including mechanical connecting means extending between said choke valve and said diaphragm member of the gasoline supply device; whereby said mechanical connecting means causes displacement of said diaphragm member towards a position in which said second chamber has a minimum volume, when said choke valve is displaced towards its operating position during starting and warming up of the engine.

2. A fuel supply system according to claim 1, wherein said choke valve actuating mechanism includes a lever pivoted to the fixed structure of the carburetor, said connection mechanism comprising a rod having one end connected to the diaphragm member of said diaphragm device, the other end of said rod being pivoted to said lever.

* * * * *